US005848625A

United States Patent [19]

Ebert

[11] Patent Number: 5,848,625

[45] Date of Patent: Dec. 15, 1998

[54] BAG FILLING DEVICE

[76] Inventor: Michael A. Ebert, 10306 Fimple Rd., Chico, Calif. 95928

[21] Appl. No.: 902,553

[22] Filed: Jul. 29, 1997

[51] Int. Cl.[6] ..... B65B 1/06

[52] U.S. Cl. ..... 141/246; 141/316; 141/334; 141/390; 141/391

[58] Field of Search ..... 141/313, 314, 141/391, 390, 331, 333, 334, 316, 246

[56] References Cited

U.S. PATENT DOCUMENTS

| | | | |
|---|---|---|---|
| 53,809 | 4/1866 | Gillett . | |
| 300,219 | 6/1884 | Cochrane . | |
| 347,393 | 8/1886 | Smith . | |
| 367,599 | 8/1887 | Conant | 141/334 X |
| 1,018,228 | 2/1912 | Appleby et al. . | |
| 1,110,018 | 9/1914 | Van Schoiack | 141/313 X |
| 1,253,948 | 1/1918 | Dugas | 141/314 X |
| 1,254,371 | 1/1918 | Smith | 141/314 X |
| 1,765,346 | 6/1930 | Rosenfeld | 141/314 |
| 1,783,423 | 12/1930 | Harper . | |
| 1,909,670 | 5/1933 | Evans | 141/314 X |
| 2,110,687 | 1/1938 | Weinstein | 226/58 |
| 2,144,923 | 1/1939 | Kester et al. | 141/334 |
| 2,623,671 | 12/1952 | Firestone | 141/391 X |
| 3,552,346 | 1/1971 | Garden | 141/72 |
| 3,771,578 | 11/1973 | Huff | 141/314 X |
| 4,073,410 | 2/1978 | Melcher | 222/181 |
| 4,139,029 | 2/1979 | Geraci | 141/98 |
| 4,240,474 | 12/1980 | Perkins | 141/231 |
| 4,241,769 | 12/1980 | Wiesner | 141/314 X |
| 4,273,167 | 6/1981 | Stillwell | 141/314 |
| 4,836,421 | 6/1989 | Miyoshi et al. | 222/166 |
| 5,397,085 | 3/1995 | Spagnolo | 248/97 |
| 5,417,261 | 5/1995 | Kanzler et al. | 141/313 |
| 5,425,403 | 6/1995 | Herrmann | 141/314 |
| 5,437,318 | 8/1995 | Kanzler et al. | 141/313 |
| 5,687,781 | 11/1997 | Grizz | 141/391 X |

*Primary Examiner*—David J. Walczak
*Assistant Examiner*—Kathleen J. Prunner
*Attorney, Agent, or Firm*—Limbach & Limbach L.L.P.

[57] ABSTRACT

An apparatus for filling flexible bags with a fluent material that includes a receiving bay, a curvilinear cylinder and a support frame. The receiving bay has an open top for receiving fluent material and funnels down to a discharge opening. The curvilinear cylinder has a top input opening attached to the discharge opening, a bottom output opening, and a curvilinear sidewall therebetween. The curvilinear sidewall has a front wall with an outwardly and downwardly projecting portion that has a predetermined length and extends away from an opposing rear wall of the curvilinear sidewall at a predetermined angle of inclination relative to the vertical direction. The support frame is attached to and supports the receiving bay or the curvilinear cylinder such that the bottom output opening of the curvilinear cylinder is suspended at a predetermined clearance height above the ground. The predetermined angle of inclination, the predetermined length, and the predetermined clearance height are selected such that a bag slipped over the bottom output opening and around the curvilinear cylinder will remain suspended thereby by friction. As fluent material is deposited into the receiving bay and passes through the curvilinear cylinder and into the bag, the bag gradually slides down the curvilinear cylinder due to the weight of the fluent material inside the bag until the bag rests on the ground, at least partially filled with the fluent material, in a generally upright position.

24 Claims, 6 Drawing Sheets

BAG FILLING DEVICE

FIELD OF THE INVENTION

The present invention relates to bag filling devices, and more particularly to a bag filling device for quickly and efficiently filling flexible bags with a fluent material, such as sand.

BACKGROUND OF THE INVENTION

Sand bags are typically used to control flooding and/or to shore up saturated earth. Plastic or burlap bags are filled with sand and placed on top of each other and/or in a line to form a water proof barrier that prevents flooding or movement of the saturated earth.

Filling and placing bags of sand often occurs on very short notice in emergency flood conditions caused by heavy rain. Often times, the area at flood risk is located in a remote area. Large numbers of sand bags need filling and placement in a very short period of time to minimize property damage due to flood waters and movement of saturated earth. In emergency situations, sand and bags are generally dumped off at or as near to a flood sight as possible, where they are filled and used to divert flood waters.

The most typical method of filling a sand bag is performed by having one person shovel sand into a flexible plastic or burlap bag that is held open by another person. The bag needs to be flexible so that when filled and placed, it conforms with any irregularities in the surface upon which it is placed. While it is conceivable for one person to both hold and fill a sand bag, that process is very cumbersome and experience dictates that is not an efficient method of filling sand bags.

There are several common traits to flooding in populated areas. The event is seldom anticipated. Much flooding occurs in areas previously thought to be not flood prone. Residents, business owners and local authorities are overwhelmed by the extent of flooding. The result is almost always an emergency situation requiring massive amounts of filled sand bags, often times in distant or remote locations. Teams of emergency workers and volunteers armed with shovels manually fill bags with sand, and then place them in the use area as quickly as possible.

Commercial or industrial sand bagging machines have been developed to fill sand bags more quickly, Large storage hoppers with trap doors and motors are used to feed the stored sand into bags. However, these devices are expensive, require a trained crew to operate, are not portable, and are not practical in most flood situations. Most flood prone areas do not have the resources to store filled bags of sand, or buy and store expensive and complicated sand bagging machines. Some local communities buy sand and bags, and fire stations and lot owners strategically located near flood prone areas have been used as hubs for storing the sand and empty bags for emergency use later. For areas totally unprepared for flooding, sand and bags are trucked in as quickly as possible. The reality of emergency flood control is that the resources of the situation usually only include sand piles, empty bags, shovels, and many emergency and volunteer workers.

In order to increase the efficiency of filling bags with shovelled sand, aluminum extension ladders have been used with inverted safety cones, where one individual holds the bag up beneath the cone as another shovels sand into the safety cone. Plywood funnels and other hastily devised contraptions abound in prolonged emergency situations. Bag holding devices have also been developed, as illustrated in U.S. Pat. Nos. 347,393; 1,018,228; 1,765,346; 5,397,085; and 5,425,403. Such bag holding devices hold up the rim of the bag so that the bag can be filled. However, these devices rely on lever arms, hooks, overlapping hoops, or human support to hold the bag in position, which have many disadvantages. It takes valuable time to properly hook an empty bag in place, and de-hook a filled bag when the shovelling is completed. Hooks also tend to rip the bag, and bags tend to fall off of hooks in an unreliable manner. More complicated lever arms, hoops etc. rely on complicated moving parts to support the bag in place. Not only do these moving devices take up valuable time to operate and/or learn to operate, but they also increase the expense of the device and require maintenance. For devices stored outside, moving parts can rust and then break or fail to properly operate during use. Hooks or moving parts also can injure frantically working personnel operating sandbagging devices. Lastly, many of these devices have a high fill height which requires the person with the shovel to lift the sand well over their waste. and there is no means for using a tractor loader to load sand into bags if one were available.

There is a need for a sand bag loading device that incorporates a simple and inexpensive construction, contains no moving parts, reliably supports and holds open a flexible bag to facilitate quick and reliable loading of sand therein, easily and quickly connects to an empty bag, easily and quickly disconnects from a filled bag, is operable by a single person, and facilitates a low fill height. It is also desirable to provide a bag loading device that can directly fill bags with sand from a tractor loader for those situations where one is available.

SUMMARY OF THE INVENTION

The present invention solves the aforementioned problems by providing a static device that supports an empty flexible bag slipped thereon, and as the bag fills with fluent material such as sand, the bag gradually slides off the device resulting in a bag filled with the fluent material and resting on the ground in a substantially upright position. The device, through friction only, suspends the bag while holding the bag open once the bag is slipped onto the device, it holds the bag open while the bag is being filled, and it holds the upper portion of the bag once the bag is filled. No hooks, straps, clamps or other moving parts are used to affix the bag to the device or need removing from the bag once the bag is filled.

The present invention is an apparatus for filling a bag with a fluent material that includes a receiving bay, a curvilinear cylinder and a support frame. The receiving bay has an open top for receiving fluent material and downwardly converges into a discharge opening. The curvilinear cylinder has a top input opening attached to the discharge opening, a bottom output opening, and a curvilinear sidewall therebetween. The curvilinear sidewall has a front wall with an outwardly and downwardly projecting portion that has a predetermined length and extends away from an opposing rear wall of the curvilinear sidewall at a predetermined angle of inclination relative to the vertical direction. The support frame is attached to and supports the receiving bay or the curvilinear cylinder such that the bottom output opening of the curvilinear cylinder is suspended at a predetermined clearance height above the ground. The predetermined angle of inclination, the predetermined length, and the predetermined clearance height are selected such that a bag slipped over the bottom output opening and around the curvilinear cylinder will remain suspended thereby by friction. As fluent material is deposited into the receiving bay and passes through the curvilinear cylinder and into the bag, the bag gradually slides down the curvilinear cylinder due to the weight of the fluent material inside the bag until the bag rests on the ground, at least partially filled with the fluent material, in a generally upright position.

A plurality of bag filling devices each with a separate receiving bay, curvilinear cylinder and support frame, can be attached together in a line for filling a plurality of bags with fluent material simultaneously.

Other objects and features of the present invention will become apparent by a review of the specification, claims and appended figures.

DETAILED DESCRIPTION OF THE PREFERRED EMBODIMENTS

Figure 1:
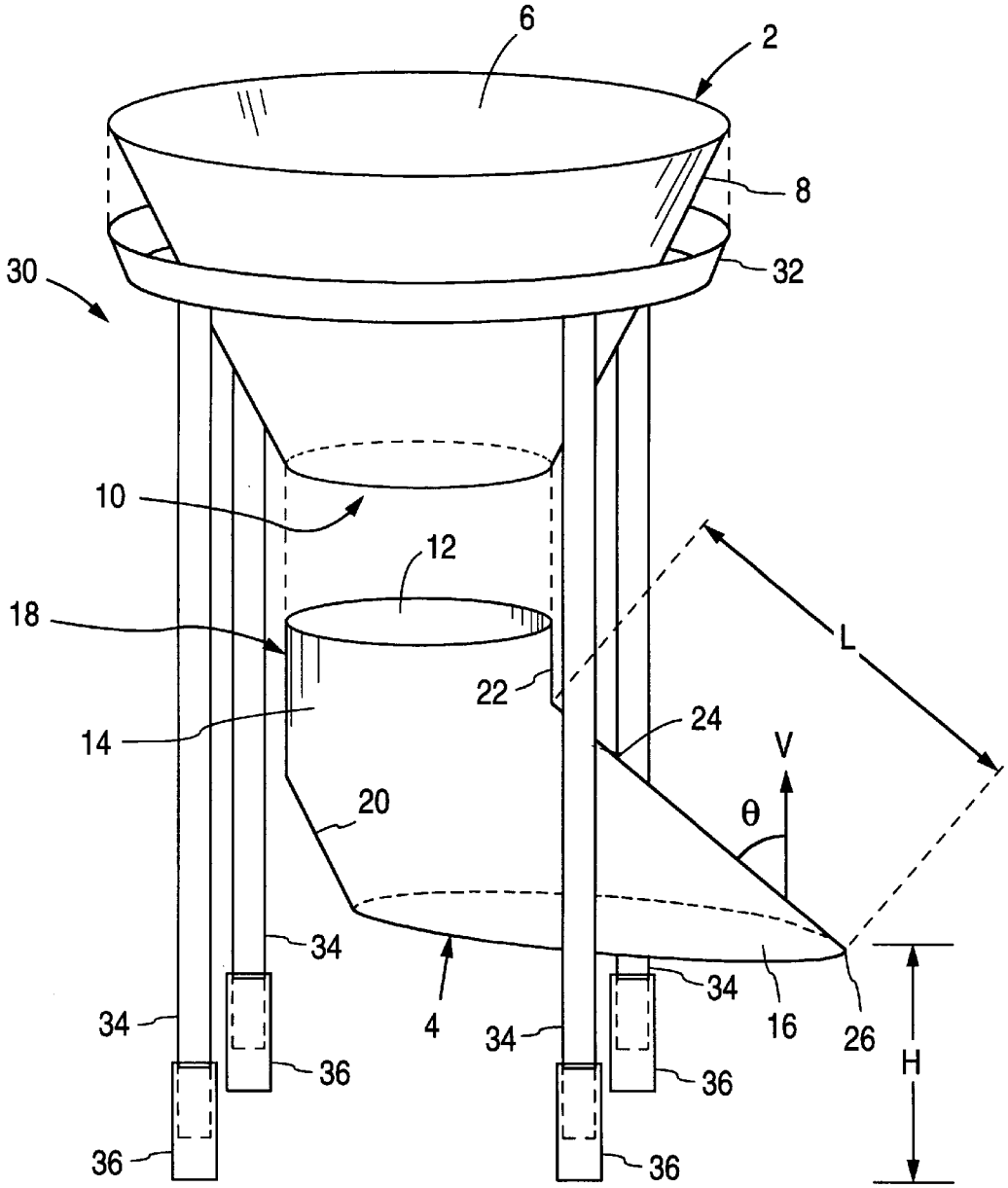
FIG. 1 is an exploded perspective view of the bag filling device of the present invention.
Figure 2B:
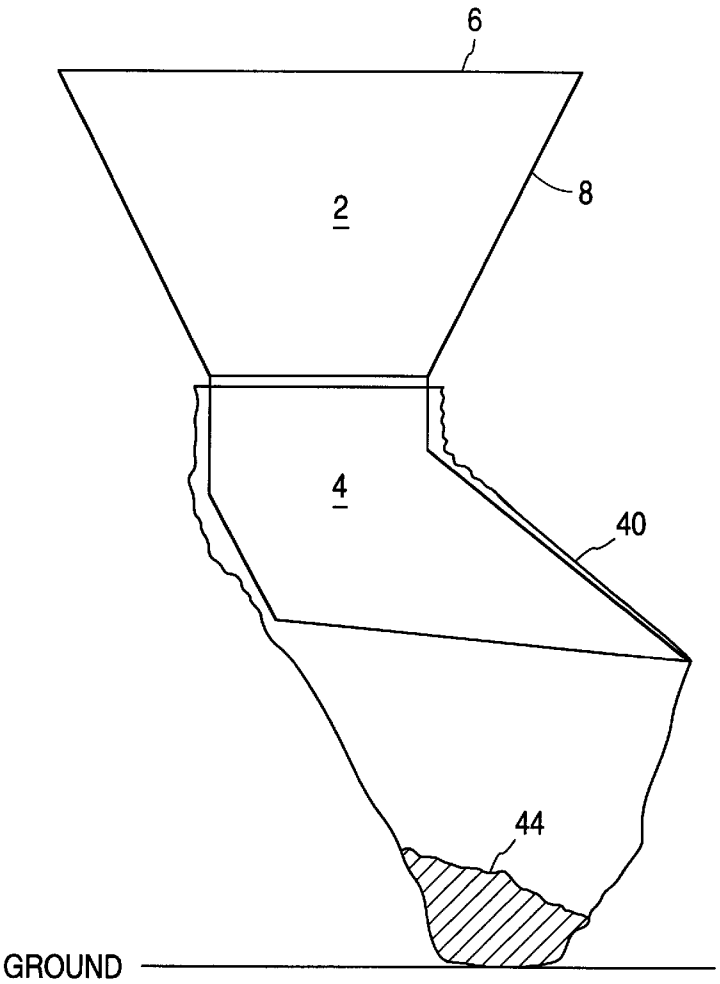
FIGS. 2A–2D are side cross-sectional views of the bag filling device progressively illustrating a bag being filled with a fluent material.
Figure 2A:
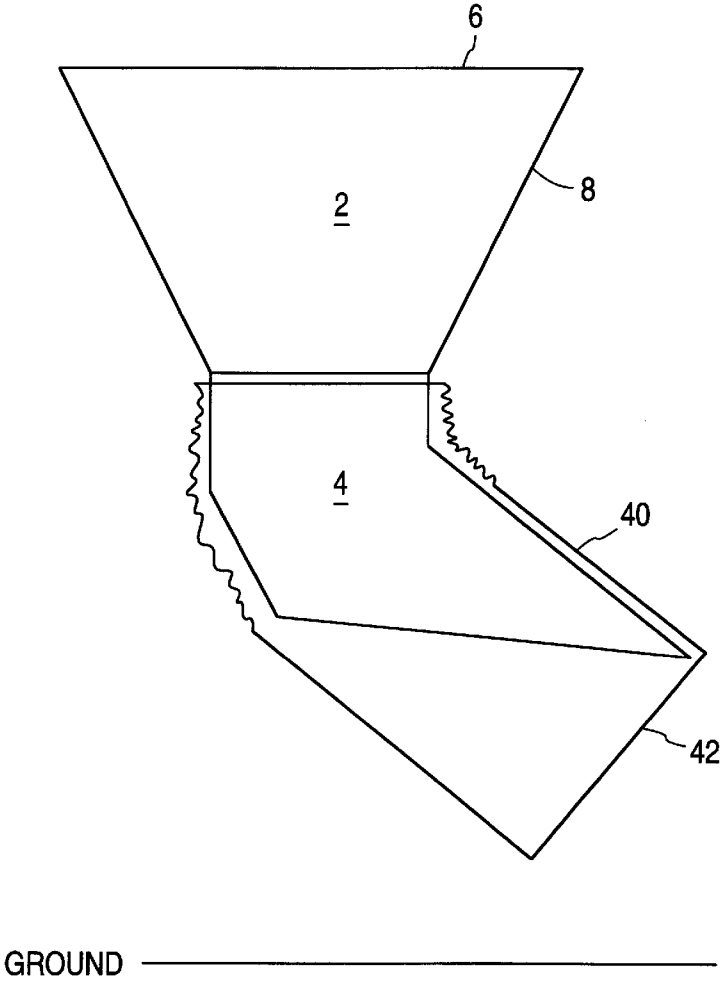
Figure 2D:
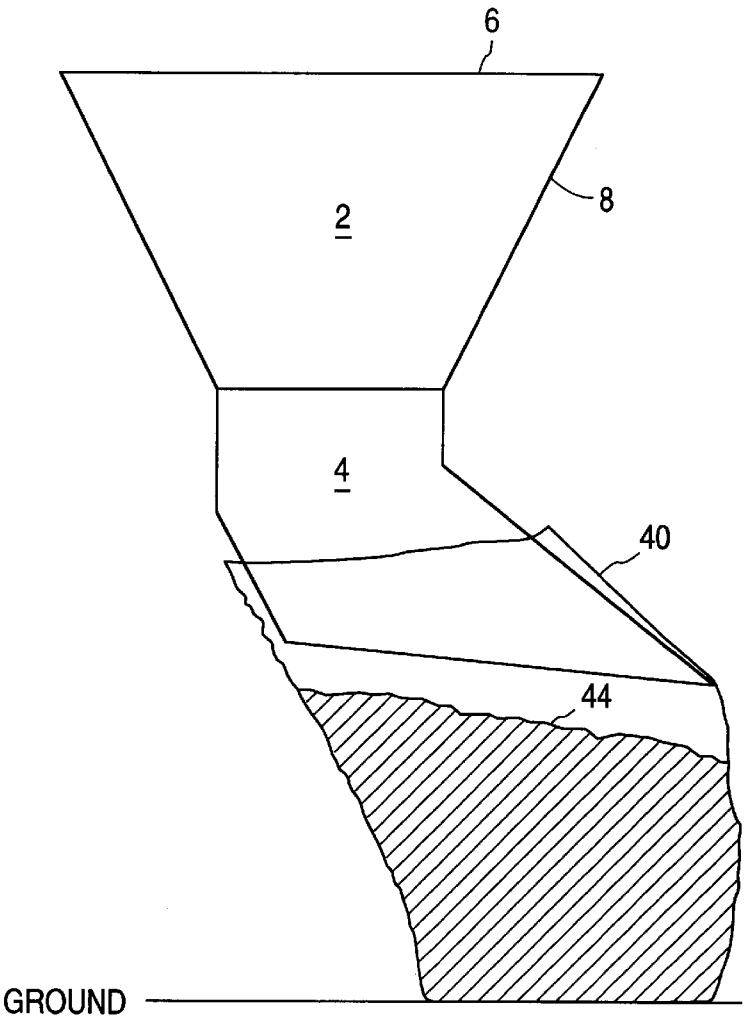
Figure 2C:
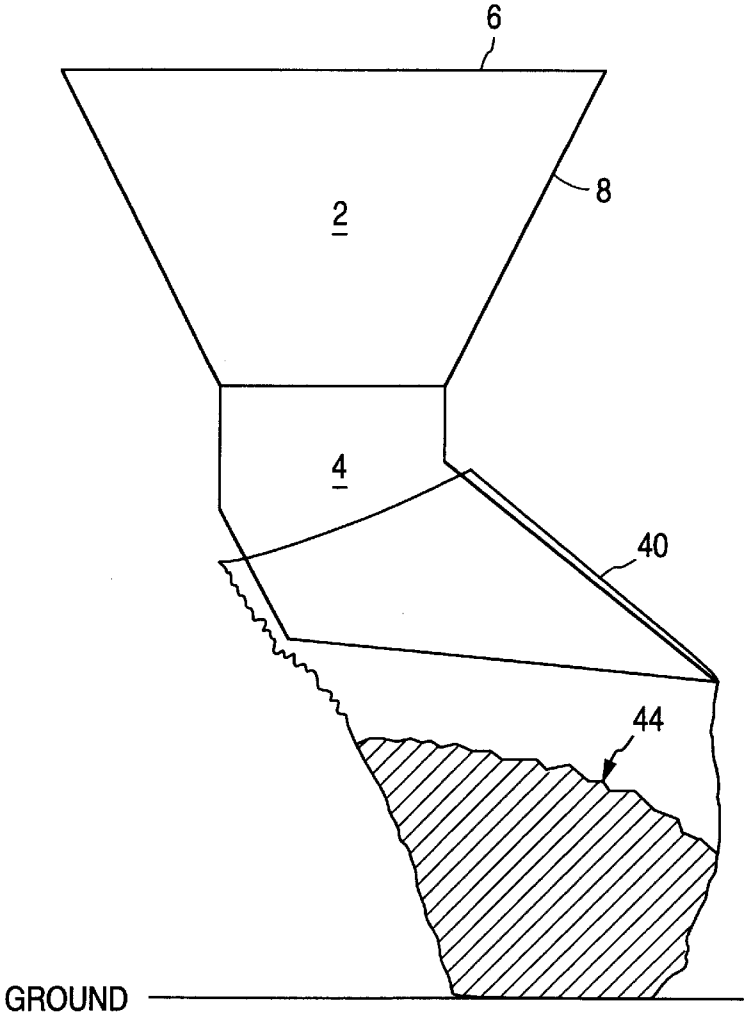

The present invention is a bag filling device ideal for filling flexible bags with a fluent material, such as sand. The bag filling device 1 is illustrated in FIGS. 1, and includes a funnel-shaped receiving bay 2 and a curvilinear cylinder 4.

The receiving bay 2 has an open top 6, a funnel shaped side wall 8, and a lower discharge opening 10. The open top 6 has a larger diameter than the discharge opening 10. The larger open top 6 gives the user a larger target for depositing the fluent material.

The curvilinear cylinder 4 has an upper input opening 12, a curvilinear side wall 14, and a lower output opening 16. The upper input opening 12 has a similar size to, and is attached to, the discharge opening 10. The curvilinear side wall 14 has a rear surface 18 that includes an inwardly projecting portion 20, and a front surface 22 that includes an outwardly projecting portion 24 that extends in the same direction as inwardly projecting portion 20. The outwardly projecting portion 24 extends outwardly and downwardly at a predetermined angle θ relative to the vertical V, and has a predetermined length L. The bottom edges of inwardly projecting portion 20 and outwardly projecting portion 24 define discharge opening 12.

The receiving bay is supported by a frame 30, which includes horizontal ring 32 for supporting the receiving bay 2 and vertical leg members 34 for supporting the receiving bay 2 and curvilinear cylinder 4 at a desired height above the ground. Vertical leg members 34 can include telescoping members 36 for varying the clearance height H of the end tip 26 of curvilinear cylinder 4 above the ground. The predetermined angle θ, length L, and height H are selected so that an empty bag can be suspended from projecting portion 20, and the bag gradually slides downwardly as it is filled with sand, as described below.

FIGS. 2A–2D illustrate the operation of bag filling device 1. A flexible bag 40 is placed over curvilinear cylinder 4 so that one corner of the bag bottom 42 is positioned adjacent the tip end 26 of the outwardly projecting portion 24. The upper open-end portion of the bag 40 is bunched together around the upper portion of the curvilinear cylinder 4. The length L and predetermined angle θ of outwardly projecting portion 24 are selected so that friction between bag 40 and projecting portion 24 will keep the bag suspended above the ground and held open, without sliding off of curvilinear cylinder 4.

As a fluent material 44, such as sand, is shovelled or otherwise deposited into the receiving bay 2, the sand is compressed by the upper portion of the curvilinear cylinder 4 and deposited into the bottom 42 of the suspended bag 40 by the force of gravity. As the bag 40 fills with sand 44, the increasing weight of the sand 44 in the bag causes bag 40 to gradually slide down the curvilinear cylinder 4 until the bottom 42 of the bag 40 rests on the ground. Both before and after the bag bottom reaches the ground, the bag's upper portion is suspended and held open by the curvilinear cylinder 4 for receiving more sand 44. After the bag has been filled to a desired level, the upper portion of the bag is slid off of the curvilinear cylinder 4 by the user, leaving the bag resting substantially upright on the ground. The filled bag is slid or carried out of the way, and another bag is slipped over the curvilinear cylinder 4 to begin the filling process again. Alternately, the filled bag can remain resting on the ground and the device 1 slid to one side for filling the next bag. Therefore, empty bags suspended by the bag filling device 1 can be pre-positioned over the use area before being filled, and can be left in their filling positions once filled.

The key feature of this invention is outwardly projecting portion 24, which suspends the empty bag by friction only while holding the bag open after the bag is loaded onto the device 1. The present invention also holds the bag open while the bag is being filled and while gravity acting on the sand therein gradually removes the bag from the device 1. The device 1 even holds the upper portion of the bag once the bag is filled. No hooks, straps, clamps etc. (which can rust, break and/or injure frantically working sandbagging personnel) are necessary to operate this device. By merely slipping the bag into place and feeding sand into the receiving bay, a filled bag resting substantially upright on the ground results. The filled bag is quickly and easily removable from the bag filling device 1 by merely slipping off the bag's top portion from curvilinear cylinder 4. In order for the curvilinear cylinder 4 to suspend an empty bag, and to cause the bag to partially slide off curvilinear cylinder 4 as the bag is filled, the angle of inclination θ and the length L must be selected appropriately. These values will depend upon the size of the bag that is filled with the sand using the device 1. For a given bag size, a range of inclination angles θ and lengths L will work. Likewise, for any given set of values θ, L and H, a range of bag sizes will work with a bag filling device having those set values. However, if the inclination angle θ is too large, the bag will not fill properly or slide down correctly. If the length L is too long, the upper portion of the bag will not reach the upper portion of the curvilinear cylinder 4, and the sand will not reach the bag bottom. If the inclination angle θ is too small, or the length L too short, the bag will not stay properly suspended before and during the bag filling process.

Inwardly projecting portion 20 helps ensure that the bag fills evenly from the bottom up, and that device 1 produces a filled bag resting substantially upright on the ground. Inwardly projecting portion 20 functions to redirect some of the falling sand toward the outwardly projecting portion 24, and therefore toward the bottom 42 of the bag suspended therefrom. With a portion of the sand directed in this manner, it has been discovered that the bag fills fairly evenly from the bag bottom on up. Without inwardly projecting portion 20, the vertically falling sand tends to strike the side of the suspended bag, and can result in the bag either not reliably sliding off of cylinder 4 as it fills, or filling such that the bag rests partially on its side when filled.

The invention design emphasizes portability, a low profile, ease and simplicity of operation, and operability by a single user. An individual user simply slips a bag onto the curvilinear cylinder 4, shovels sand into the receiving bay 2, pulls the top of filled bag off the cylinder 4, and slips on another bag to repeat the process. The invention helps fill the bag to the desired level as set by the adjustable clearance height H of the curvilinear cylinder 4 above the ground. A single embodiment of given dimensions will work with many size bags, wet or dry sand, and without having to provide a means for adjusting the angle of inclination θ or the length L. Further, the device is essentially maintenance free, with no moving parts and no appliances necessary to affix the bag to the device, thus storing well for long periods of time even if exposed to the elements. The device is easily transportable in quantity by truck or trailer for deployment to and retrieval from remote locations on short notice. Finally, the device 1 can be operated by a single person as described above, or by multiple persons for increased sand bagging speed.

The low profile of the device 1 is of critical importance. As the sand is shoveled, an arc of movement is created from the sand pile to the receiving bay 2. Dry sand is very heavy. Sand that is partially saturated with rain water is even heavier. Since sand used for sandbagging is often wet and therefore quite heavy, the height of the present invention is designed to be lower than that of an ordinary wheelbarrow. The low profile minimizes the height sand must lifted, and the distance the sand must travel from the sand pile to the bottom of the sand bag, thus minimizing the energy expenditure by those filling the sand bags.

Bags commonly used for sandbagging are available in several sizes. Sand bags cannot be too large due to the heavy weight of sand. Sandbags are almost always manually placed even if transported in mass in a filled condition, and cannot be too heavy for manually lifting and placement. Three standard size bags are traditionally used for sandbagging: 14"×26", 18"×27", and 23"×34". The first two are typically tied closed before placement at the use area, and the third is large enough for the upper portion to be folded underneath the bag when placed. Bags larger or smaller than these are seldom used. These bags typically weigh about 50 to 60 pounds when filled with sand.

Figure 3A:
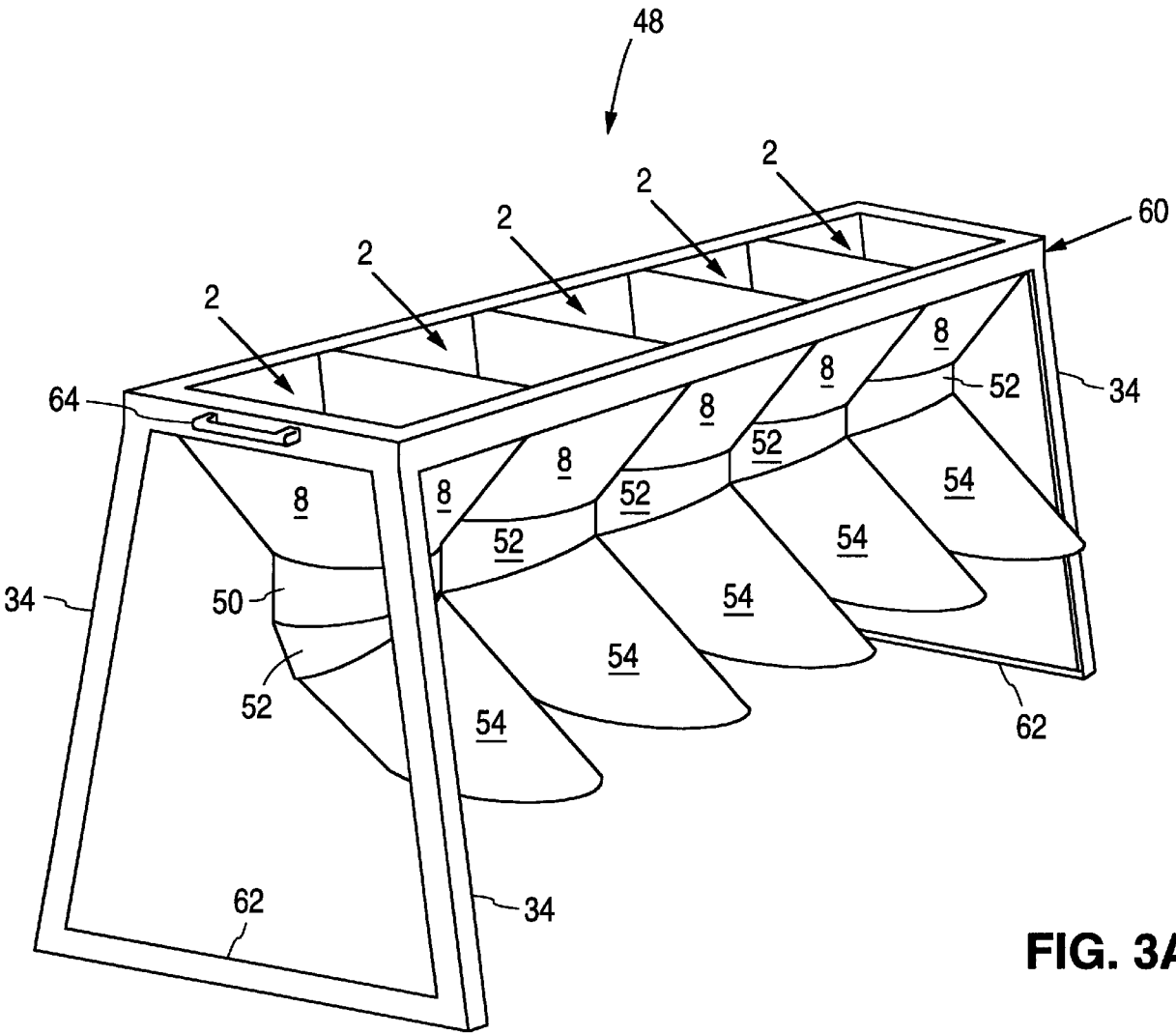
FIG. 3A is a perspective view of a preferred embodiment of the present invention.
Figure 3C:
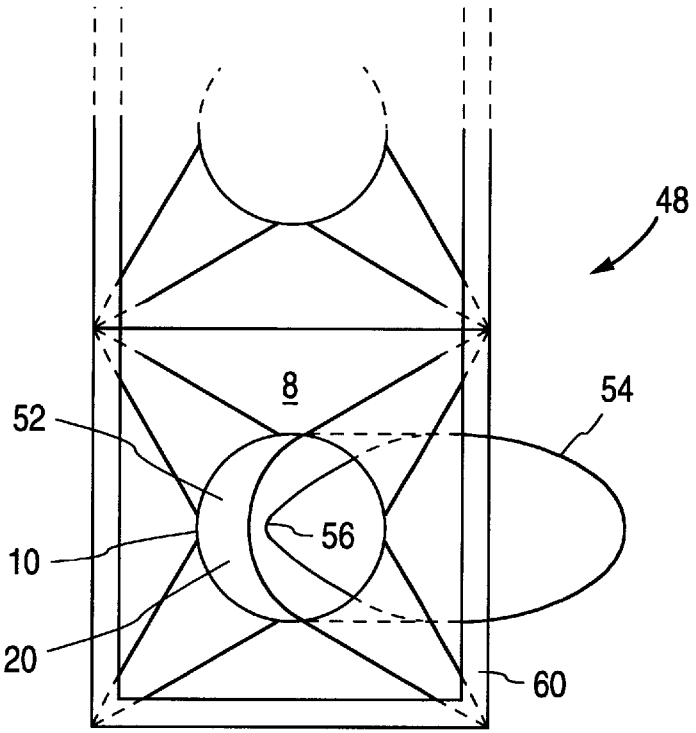
FIG. 3C is a top view of the preferred embodiment of the present invention.
Figure 3B:
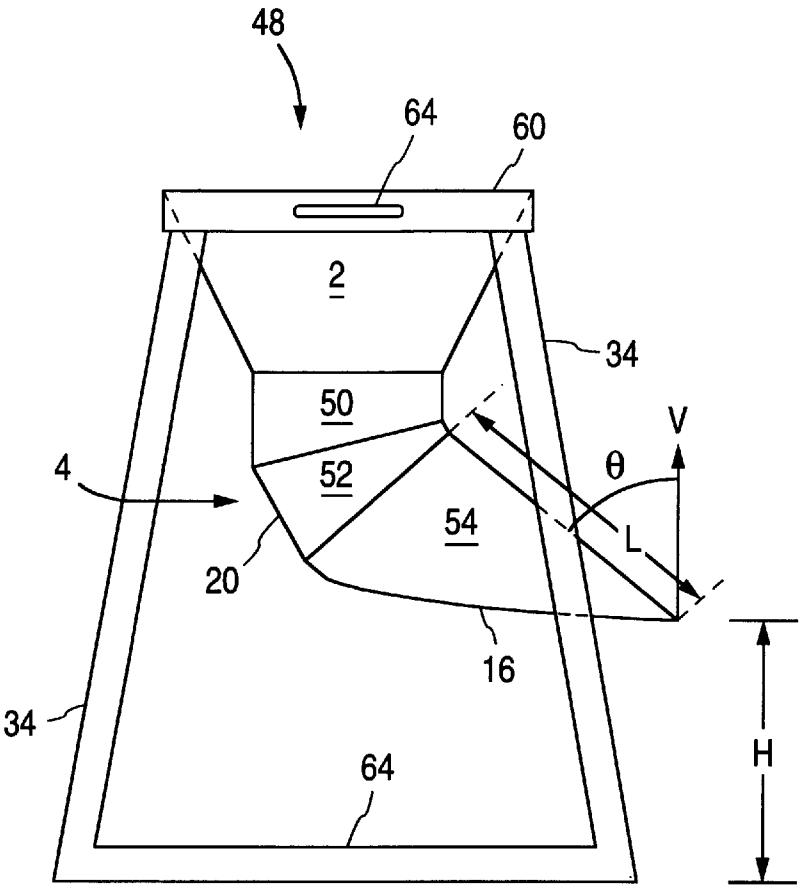
FIG. 3B is a side view of the preferred embodiment of the present invention.

The present inventor has constructed a preferred embodiment, illustrated in FIGS. 3A–3C, that efficiently fills the three common bag sizes listed above with sand. Like parts from the embodiment of FIG. 1 are numbered with the same reference numbers.

The preferred embodiment illustrated in FIGS. 3A–C is a multi bay apparatus 48 that includes five sand filling devices 1 formed or attached together in a line. Each sand filling device 1 includes a rectangularly shaped receiving bay 2, which tapers down to a circular discharge opening 10. The curvilinear cylinder 4 is comprised of three separately formed cylindrical pieces that are welded together: a first and second wedge cut cylinders 50 and 52, and a cylindrical piece 54. The diameters of first and second wedge cut cylinders 50/52 ideally match the diameter of discharge opening 10. The top and bottom edges of cylinders 50/52 are cut or formed at non-normal angles relative to the sidewalls thereof to cause the back wall of cylinder 52 to form the inwardly projecting portion 20. At least the bottom edge of cylinder piece 54 is cut or formed at an angle relative to the sidewalls thereof to form the bottom output opening 16 that is substantially parallel to the ground. The cylinder piece 54 includes a narrow lip 56 between its top and bottom edges to facilitate the welding of cylinder piece 54 onto angled cylinder 52. Cylinders 50/52 and cylinder piece 54 are preferably made from cutting existing cylinder stock at the various angles.

The frame 30 has slightly angled legs 34 attached to a rectangular-shaped horizontal support member 60 that attaches to and supports the upper edges of the receiving bays 2. Support member 60 also protects the receiving bays from shovel blows that may occur during manual shovelling of sand into the devices 1. The angled legs 34 provide an enlarged base area for stability. Horizontal stabilizing members 62, which lie along the ground and attach between the lower ends of legs 34, act to stabilize the frame 30. Handles 64 are attached to support member 60 to facilitate movement of the bag filling apparatus 48. The apparatus 48 is also stackable for ease of storage.

In the preferred embodiment, the frame 30 ideally holds the upper edges of receiving bays 2 at a height of 27 inches above the ground. Each open top 6 is 14 inches square, and tapers down to the circular discharge opening 10 having a diameter of 8 inches. The angled cylinder 52 forms inwardly projecting portions 20 having a length of 4 inches.

It has been determined that a curvilinear cylinder 4 having an outwardly projecting portion with a length L of 12 inches, and with an angle of inclination θ relative to the vertical V of 52 degrees, supported with a clearance height H of about 10 inches above the ground, is optimal for loading sand into any of the three standard sandbag sizes discussed above. However, adequate bag filling can be achieved with these three standard sandbags with a device 1 having an angle of inclination θ between about 45 to 55 degrees from the vertical V, a length L between about 10 to 14 inches, and a clearance height H between about 8 to 11 inches. In addition, if the devices 1 of apparatus 48 will be used solely with standard sized sandbags, then telescoping members 36 are unnecessary to raise or lower the apparatus 48.

The multi bay apparatus 48, with multiple bag filling devices 1 banked together, allows one or more operators to fill multiple bags simultaneously. A team of workers shovelling sand into receiving bays 2 from one side of the apparatus 48, with workers on the other side affixing empty bags and removing filled bags, results in an extremely efficient use of available labor to produce the maximum number of filled sand bags. Further, if a tractor loader with a scoop is available, the loader can simultaneously fill all the receiving bays 2 with sand, where the workers need only load empty bags and remove filled bags from the devices 1, thus producing a high number of filled bags of sand in a short amount of time. The preferred embodiment is 6 feet long, which matches the standard width of a loader's scoop.

It should be noted that very wide bags can be used with the apparatus 48, where the wide bag is inserted over two or more of the curvilinear cylinders 4 at once. This application is ideal for large bags that are positioned over the use area before they are filled. Once an empty bag is suspended by the apparatus 48, the apparatus 48 is positioned over the use area and the bag is then filled. After filling, the apparatus 48 is moved away leaving the filled bag resting on the use area. There is no need to try to move the pre-positioned filled bag, which may be too heavy to move anyway.

The multi-bay apparatus 48 is ideally made of aluminum or steel having a thickness of about 14 gauge to ⅛ of an inch, so that it is light in weight to aid in portability and storage. The different device parts can be stamped out of flat sheet stock and bent into shape, or cut from preformed parts (i.e. preformed cylinders).

Figure 4:
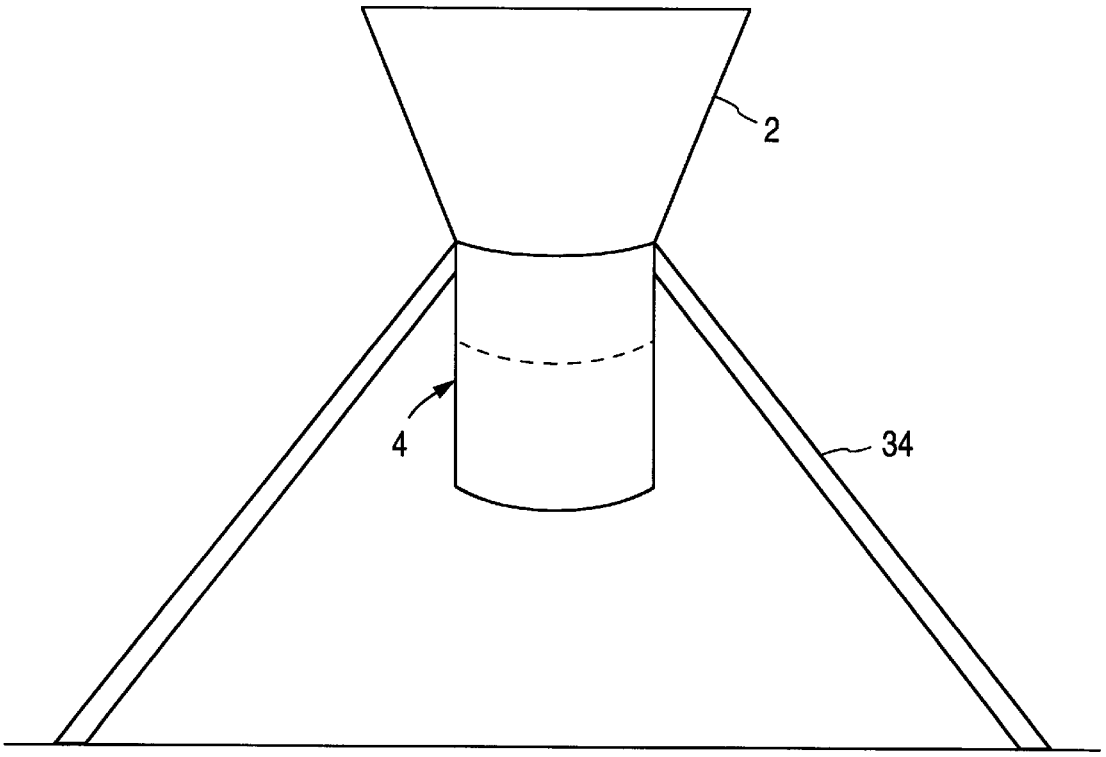
FIG. 4 is a side view of an alternate embodiment of the present invention, with the leg members attached to the curvilinear cylinder.

It is to be understood that the present invention is not limited to the embodiments described above and illustrated herein, but encompasses any and all variations falling within the scope of the appended claims. For example, the present invention has been described for use with filling plastic or burlap bags with sand. However, the present invention is ideal for loading any fluent material, such as seed, fertilizer, ice, gravel, foods, etc., into any flexible bag. The receiving bay 2 need not be funnel shaped and could have vertical side walls 8. Further, wedge cut cylinders 50/52 can be combined into a single wedge cut piece, or include a plurality of individual cylinder wedges. In addition, leg members 34 can be connected directly to the curvilinear cylinder 4 instead of the receiving bay 2, as illustrated in FIG. 4.

What is claimed is:

1. An apparatus for filling a bag with a fluent material, the apparatus comprising:

a receiving bay that has an open top for receiving fluent material and downwardly converges into a discharge opening;

a curvilinear cylinder having a top input opening attached to the discharge opening, a bottom output opening, and a curvilinear sidewall therebetween, the curvilinear sidewall having a front wall with an outwardly and downwardly projecting portion that has a predetermined length and extends away from an opposing rear wall of the curvilinear sidewall at a predetermined angle of inclination relative to the vertical direction so as to define a gradually enlarging flow path for the fluent material; and a support frame attached to and supporting one of the receiving bay and the curvilinear cylinder such that the bottom output opening of the curvilinear cylinder is suspended at a predetermined clearance height above the ground;

wherein the predetermined angle of inclination, the predetermined length, and the predetermined clearance height are selected such that a bag slipped over the bottom output opening and around the curvilinear cylinder will remain suspended thereby by friction, and as fluent material is deposited into the receiving bay and passes through the curvilinear cylinder and into the bag, the bag gradually slides down the curvilinear cylinder due to the weight of the fluent material inside the bag until the bag rests on the ground, at least partially filled with the fluent material, in a generally upright position.

2. The apparatus for filling a bag as recited in claim 1, wherein the rear wall of the curvilinear sidewall has an inwardly projecting portion that extends inwardly in a direction toward the front wall such that at least some of the fluent material travelling through the curvilinear cylinder is redirected by the inwardly projecting portion toward the front wall.

3. The apparatus for filling a bag as recited in claim 2, wherein the receiving bay is funnel shaped so that the open top is larger than the discharge opening.

4. The apparatus for filling a bag as recited in claim 3, wherein the receiving bay includes a sidewall that has a rectangle to round taper so that the open top is rectangular in shape and the discharge opening is round in shape.

5. The apparatus for filling a bag as recited in claim 2, wherein the support frame includes a plurality of legs that are adjustable in length to adjust the predetermined height.

6. The apparatus for filling a bag as recited in claim 2, wherein the predetermined angle of inclination is between about 45 to 55 degrees from the vertical.

7. The apparatus for filling a bag as recited in claim 6, wherein the predetermined length is between about 10 to 14 inches.

8. The apparatus for filling a bag as recited in claim 7, wherein the predetermined clearance height is between about 8 to 11 inches.

9. The apparatus for filling bags as recited in claim 2, wherein the curvilinear cylinder includes a wedge shaped first cylinder member having at least one end thereof formed at a non-normal angle relative to a sidewall thereof, the wedge shaped cylinder is mounted below the receiving bay by the one end so that a portion of the sidewall thereof forms the inwardly projecting portion of the rear wall.

10. The apparatus for filling a bag as recited in claim 9, wherein the curvilinear cylinder includes a second cylinder member having at least one end thereof which is formed at a non-normal angle relative to a sidewall thereof and which forms the bottom output opening, a portion of the second cylinder member sidewall forms the outwardly projecting portion of the front wall.

11. The apparatus for filling a bag as recited in claim 2, wherein the curvilinear cylinder includes a plurality of cylinder members, one of the plurality of cylinder members has an end thereof cut at a non-normal angle relative to a sidewall thereof the cylinder members are mounted together and below the receiving bay such that the non-normal cut end causes a side wall of one of the cylinder members to form the inwardly projecting portion of the rear wall.

12. The apparatus for filling a bag as recited in claim 11, wherein another one of the plurality of cylinder members has at least one end thereof which is formed at a non-normal angle relative to a sidewall thereof and which forms the bottom output opening, a portion of the sidewall of the another one of the plurality of cylinder members forms the outwardly projecting portion of the front wall.

13. An apparatus for filling bags with a fluent material, the apparatus comprising:

a plurality of bag filling devices each including:

a receiving bay that has an open top for receiving fluent material and downwardly converges into a discharge opening, a curvilinear cylinder having a top input opening attached to the discharge opening, a bottom output opening, and a curvilinear sidewall therebetween, the curvilinear sidewall having a front wall with an outwardly and downwardly projecting portion that has a predetermined length and extends away from an opposing rear wall of the curvilinear sidewall at a predetermined angle of inclination relative to the vertical direction so as to define a gradually enlarging flow path for the fluent material, and a support frame attached to and supporting one of the receiving bay and the curvilinear cylinder such that the bottom output opening of the curvilinear cylinder is suspended at a predetermined clearance height above the ground, wherein the predetermined angle of inclination, the predetermined length, and the predetermined clearance height are selected such that a bag slipped over the bottom output opening and around the curvilinear cylinder will remain suspended thereby by friction, and as fluent material is deposited into the receiving bay and passes through the curvilinear cylinder and into the bag, the bag gradually slides down the curvilinear cylinder due to the weight of the fluent material inside the bag until the bag rests on the ground, at least partially filled with the fluent material, in a generally upright position; and wherein the plurality of bag filling devices are attached together side by side for loading bags with the fluent material simultaneously.

14. The apparatus for filling bags as recited in claim 13, wherein for each of the bag filling devices, the rear wall of the curvilinear sidewall has an inwardly projecting portion that extends inwardly in a direction toward the front wall such that at least some of the fluent material travelling through the curvilinear cylinder is redirected by the inwardly projecting portion toward the front wall.

15. The apparatus for filling bags as recited in claim 14, wherein for each of the bag filling devices, the receiving bay is funnel shaped so that the open top is larger than the discharge opening.

16. The apparatus for filling bags as recited in claim 15, wherein for each of the bag filling devices, the receiving bay includes a sidewall that has a rectangle to round taper so that the open top is rectangular in shape and the discharge opening is round in shape.

17. The apparatus for filling bags as recited in claim 14, wherein for each of the bag filling devices, the support frame includes a plurality of legs that are adjustable in length to adjust the predetermined height.

18. The apparatus for filling bags as recited in claim 14, wherein for each of the bag filling devices, the predetermined angle of inclination is between about 45 to 55 degrees from the vertical.

19. The apparatus for filling bags as recited in claim 18, wherein for each of the bag filling devices, the predetermined length is between about 10 to 14 inches.

20. The apparatus for filling bags as recited in claim 19, wherein for each of the bag filling devices, the predetermined clearance height is between about 8 to 11 inches.

21. The apparatus for filling bags as recited in claim 14, wherein for each of the bag filling devices, the curvilinear cylinder includes a wedge shaped first cylinder member having at least one end thereof formed at a non-normal angle relative to a sidewall thereof, the wedge shaped cylinder is mounted below the receiving bay by the one end so that a portion of the sidewall thereof forms the inwardly projecting portion of the rear wall.

22. The apparatus for filling bags as recited in claim 21, wherein for each of the bag filling devices, the curvilinear cylinder includes a second cylinder member having at least one end thereof which is formed at a non-normal angle relative to a sidewall thereof and which forms the bottom output opening, a portion of the second cylinder member sidewall forms the outwardly projecting portion of the front wall.

23. The apparatus for filling bags as recited in claim 14, wherein for each of the bag filling devices, the curvilinear cylinder includes a plurality of cylinder members, one of the plurality of cylinder members has an end thereof cut at a non-normal angle relative to a sidewall thereof, the cylinder members are mounted together and below the receiving bay such that the non-normal cut end causes a side wall of one of the cylinder members to form the inwardly projecting portion of the rear wall.

24. The apparatus for filling bags as recited in claim 23, wherein for each of the bag filling devices, another one of the plurality of cylinder members has at least one end thereof which is formed at a non-normal angle relative to a sidewall thereof and which forms the bottom output opening, a portion of the sidewall of the another one of the plurality of cylinder members forms the outwardly projecting portion of the front wall.

* * * * *